United States Patent [19]

Zwicker

[11] 4,055,026

[45] Oct. 25, 1977

[54] CLAMP FOR HOLDING ICE SKATE WHILE GRINDING BLADE

[76] Inventor: Homer A. Zwicker, Wing Road, Westford, Mass. 01886

[21] Appl. No.: 537,353

[22] Filed: Dec. 30, 1974

[51] Int. Cl.[2] ..... B24B 19/00

[52] U.S. Cl. ..... 51/228; 269/218

[58] Field of Search ..... 269/218, 237, 71–74; 51/228; 76/83

[56] References Cited

U.S. PATENT DOCUMENTS

| | | | |
|---|---|---|---|
| 454,779 | 6/1891 | Tallman | 269/237 |
| 842,007 | 1/1907 | Parker | 269/71 |
| 912,757 | 2/1909 | Thompson | 51/228 |
| 1,386,318 | 8/1921 | Cowan | 269/71 |
| 2,325,417 | 7/1943 | Merrill | 269/218 |
| 2,655,774 | 10/1953 | Fleming | 51/228 |

FOREIGN PATENT DOCUMENTS

| | | | |
|---|---|---|---|
| 328,992 | 4/1972 | U.S.S.R. | 269/71 |

*Primary Examiner*—Harold D. Whitehead
*Attorney, Agent, or Firm*—Robert T. Dunn

[57] ABSTRACT

A clamp for holding an ice skate while grinding the edge of the ice skate blade slides on a surface parallel to the plane of a grinding wheel for grinding the edge of the blade, the clamp holding the skate blade parallel to the plane of the grinding wheel, even with the edge of the wheel, so that the edge of the blade can be brought to bear on the edge of the grinding wheel along the length of the blade by sliding the clamp about on the surface; and so long as the clamp is against the surface, the edge of the blade is aligned with the edge of the grinding wheel.

8 Claims, 11 Drawing Figures

CLAMP FOR HOLDING ICE SKATE WHILE GRINDING BLADE

BACKGROUND OF THE INVENTION

This invention relates to clamps and the like for holding an ice skate while grinding the edge of the ice skate blade and, particularly where the clamp is manually manipulated by an operator to bring the held skate blade evenly against the edge of a stationary grinding wheel.

Heretofore, machines and apparatus have been proposed for holding an ice skate blade against a grinding wheel to grind the edge of the blade. The usual arrangement is to provide a clamp or the like rigidly holding the ice skate and a grinding wheel, all mounted to a common platform. Usually, the grinding wheel is fixed on the platform and the clamp holding the ice skate is moveable along a track on the platform so that the blade of the skate can be brought against the grinding wheel by moving the clamp along the track.

In some apparatus, the clamp is attached to the platform by a combination of hinges or pivots rather than a track, however, whether a track is used or hinges are used, movement of the clamp with respect to the grinding wheel is very limited. Furthermore, in all such prior apparatus, one jaw of the clamp is at fixed level above the base and so, it is at a fixed level with respect to the stationary grinding wheel, and the other jaw of the clamp is adjustable so that skate blades of different thicknesses can be gripped by the clamp. Thus, when the skate blade is relatively thin, the center of the blade between the two edges of the blade will be positioned slightly closer to the base than when the blade is relatively thick.

This situation is not particularly troublesome in such apparatus where the direction of grinding is perpendicular to the blade or, in other words, where the rotation axis of the grinding wheel disc lies in the plane of the blade, because the grinding wheel is usually six inches or more in diameter and the plane of the blade passing through the center of the blade shifts only a very small fraction of an inch relative to the grinding wheel axis when skate blades of different thicknesses are mounted in the apparatus for grinding. However, this small shift in the plane of the blade relative to the grinding wheel which occurs when thin or thick blades are mounted in the clamp becomes more significant in apparatus where the direction of grinding is parallel to the blade. In that case, the central plane of the blade is supposed to be aligned with the central plane of the grinding wheel disc so that they are co-planar. If it is not aligned, then the two edges of the skate blade will not be ground evenly.

The finishing grind of an ice skate blade is preferably parallel to the blade, because grinding then is in the direction of the blade rather than across it and the edges of the blade are ground smoother, sharper and without burs from end to end. However, even a slight misalignment of the central plane of the blade (through the center of the blade) with the central plane of the grinding disc (through the center of the wheel disc) could make the edges of the blade uneven.

SUMMARY OF THE INVENTION

It is an object of the present invention to provide an improved clamp for holding an ice skate while grinding the ice skate blade.

It is a further object to provide such a clamp for use in conjunction with a grinding wheel where at least some of the limitations of prior apparatus and machines for grinding ice skate blades are avoided.

It is another object to provide a clamp for holding an ice skate blade in position relative to a grinding wheel so that the plane of the blade through the center of the blade can be adjusted to align co-planar with the plane of the wheel through the center of the wheel.

It is a further object to provide a clamp for holding an ice skate, the clamp being readily manually manipulated by an operator with reference to a stationary grinding wheel, with manually operated controls and locks which position the blade so that the plane thereof through the center of the blade can be precisely positioned relative to the grinding wheel by merely holding the clamp against a platform.

It is a further object to provide a relatively light weight, inexpensive mechanism for firmly holding an ice skate by the ice skate blade to facilitate moving and positioning the blade relative to a grind wheel which grinds the blade.

It is a further object to provide on such a mechanism means for adjustment to facilitate firmly holding the blade even when the thickness of the blade is not uniform from one end to the other thereof.

In accordance with the principal features of the present invention, a manually held clamp is provided which holds an ice skate by the skate blade between two jaws that grip the blade along the broad sides of the blade and hold forth the edge of the blade to be ground. The jaws are each pivotally attached to a flat base plate at a pivot axel that connects eccentrically to a disc at each end of the axel. The discs are rotatably held by yokes attached to the base and each can be rotated and locked to the yoke to fix the position of the axel on the base. When the axle is locked in position, the jaws are held in pivotal position relative to the base plate by a cam attached to the plate. Rotation of the cam simultaneously pivots both gripping jaws closed so that they grip the skate blade and hold it parallel to the base with the central plane of the blade (midway between the two edges of the blade) at a fixed position relative to the base, determined by the locked axle.

Then the operator slides the clamp base plate on a fixed flat platform to bring the skate blade against the edge of a fixed grinding wheel. The finishing grind of the skate blade is made parallel to the blade and so, the central plane of the grinding wheel is parallel to the central plane of the blade and co-planar therewith.

In order to insure that the central planes of the blade and the grinding wheel are co-planar, the position of the jaw axle is adjusted by rotating and locking the discs. The discs can be independently rotated on separate yokes fastened to the base, and so the angle and distance between the axel and base can be adjusted. This is done when, for example, the grinding wheel is shifted or changed, or for blades that do not mount evenly in the clamp.

In accordance with another embodiment of the invention, a separate axle is provided for each jaw and both axels are carried eccentrically by common discs at each end which are rotated and locked by the operator. By changing the rotational position of the discs, the spacing of the two axles from the base is simultaneously changed.

These and other objects and features of the present invention are apparent from the following Description of Embodiments of the Invention, taken in conjunction with the drawings.

DESCRIPTION OF EMBODIMENTS OF THE INVENTION

Figure 1:
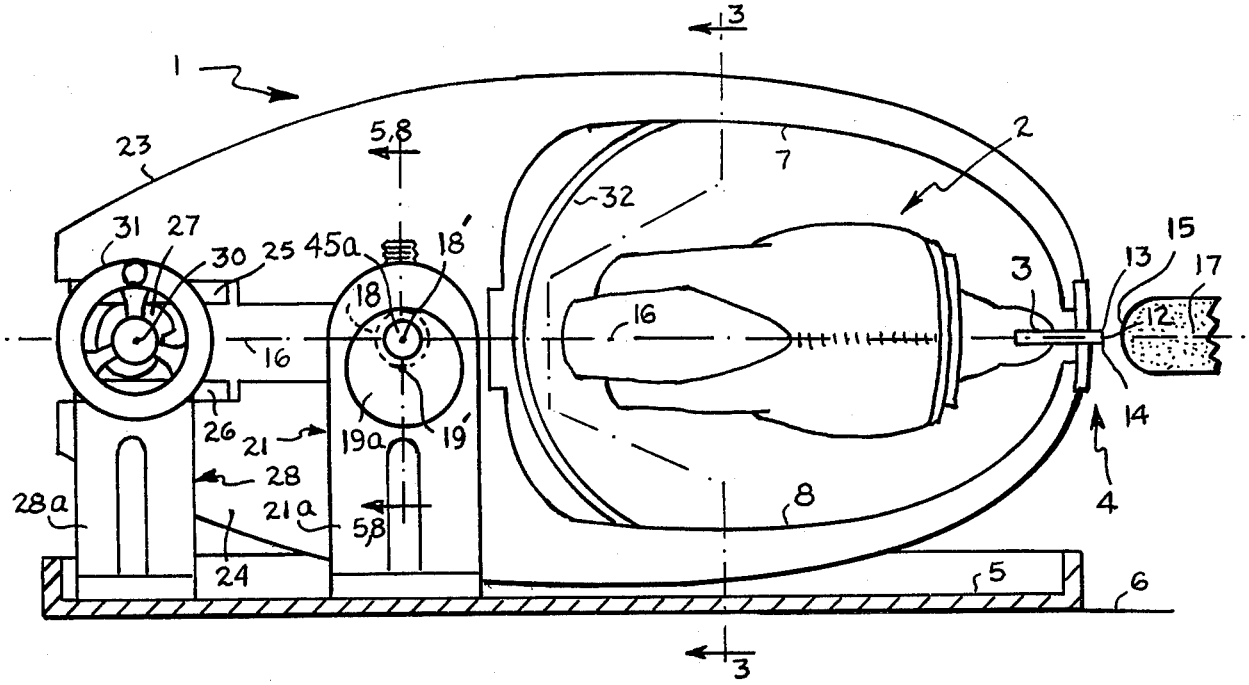
FIG. 1 is a side view of the clamp holding an ice skate by the blade supported by a horizontal platform adjacent a horizontal grinding wheel.
Figure 2:
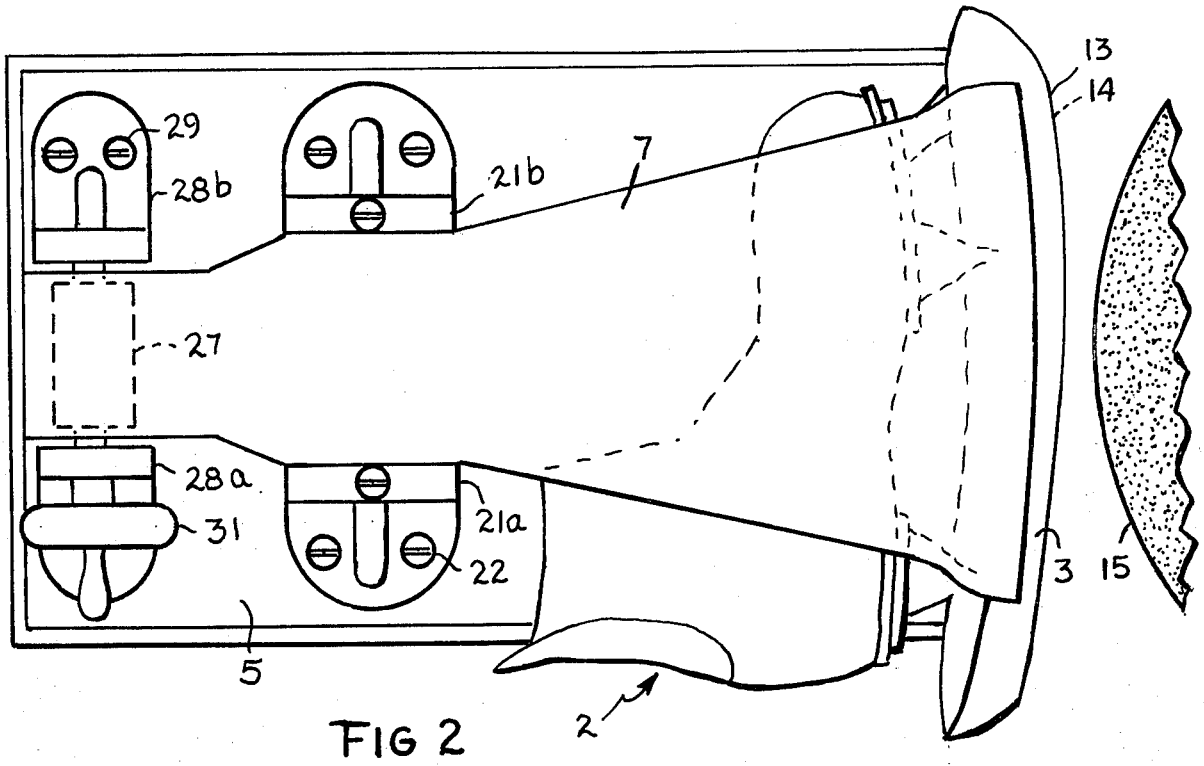
FIG. 2 is a top view of the clamp holding the ice skate.

FIGS. 1 and 2 show the clamp assembly 1 holding a typical ice skate 2 by the ice skate blade 3. The clamp assembly includes the clamp 4 carried on base plate 5 which rests on a table or platform 6. The clamp holds the ice skate blade between the upper and lower jaws 7 and 8 so that the edge 10 of the ice skate blade projects clear of the clamp and can be brought to bear against a stationary grinding wheel 11.

The position of the stationary grinding wheel 11 to perform a parallel grind, such as the finishing grind, of the edge of the ice skate blade is with the central plane of the grinding wheel co-planar with the central plane of the blade. With this orientation of the blade and wheel, a finishing grind can be obtained which is longitudinally along the blade rather than across the the blade. The finishing grind produces even, smooth edges without burs such as cannot be produced where the direction of grind is perpendicular to the length of the blade.

The finishing grind preferably produces a blade edge surface 12 which is slightly concave and so, the blade consists of two edges 13 and 14 which are smooth, parallel and sharp and have a slightly concave surface 12 inbetween. Clearly, the degree of concavity of the blade surface 12 depends upon the curvature of the edge 15 of the grinding wheel, as viewed in the figure.

In order to insure that the two edges 13 and 14 of the blade are parallel and even and the surface 12 inbetween is properly concave, it is necessary that the central plane 16 of the ice skate blade and the central plane 17 of the grinding wheel be co-planar. Hence, the ice skate is held by the blade, as shown in FIG. 1 with the central plane 16 of the blade parallel to the table 6 at a fixed distance therefrom and that distance is the same for the central plane 17 of the grinding wheel disc. When these dimensions are fixed and equal, then the operator need only move the clamp assembly by sliding it on the table 6 to bring the edge of the blade into proper alignment with the grinding wheel to make the finishing grind.

The clamp assembly 1 is preferably made as much as possible of light weight material, such as aluminum. The upper and lower jaws 7 and 8 of the clamp are unitary pieces pivotally mounted on a common axle or on separate eccentric axles carried by discs at each end which are rotatably positioned in a yoke 21 that attaches to the base plate 5. The yoke 21 consists of two pedestals **21*a* and 21*b* which may be identical to each other and aligned as shown in FIG. 2 so that each supports a disc and each is firmly fastened to the base plate 5 by, for example, screws 22.**

First Embodiment — Common Axel

Figure 5:
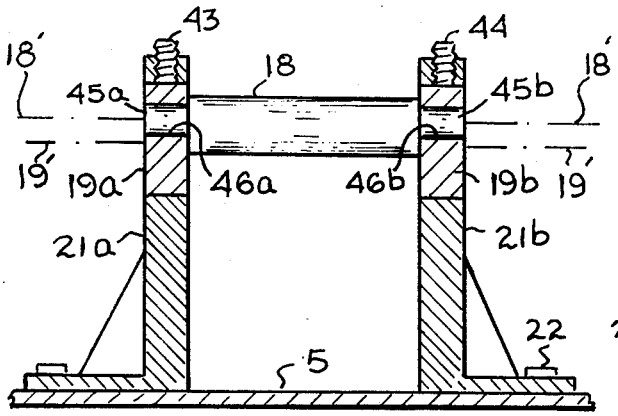
FIG. 5 is a front sectional view showing the jaw axle and eccentric mounting discs of the first embodiment.
Figure 6:
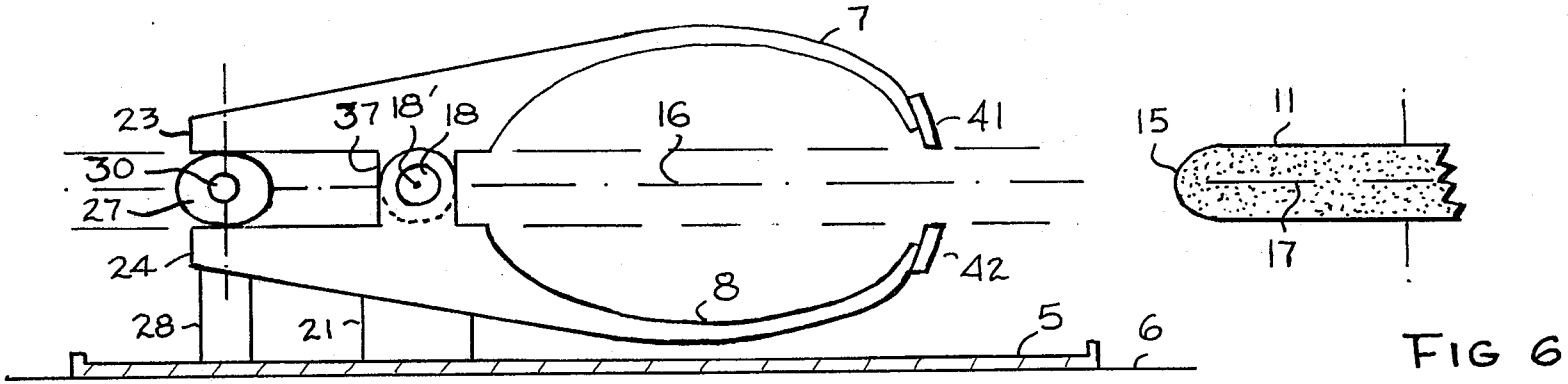
FIGS. 6 and 7 are representative side views showing the first embodiment with jaws opened and closed to hold an ice skate blade aligned with the grinding wheel for the finishing grind.
Figure 7:
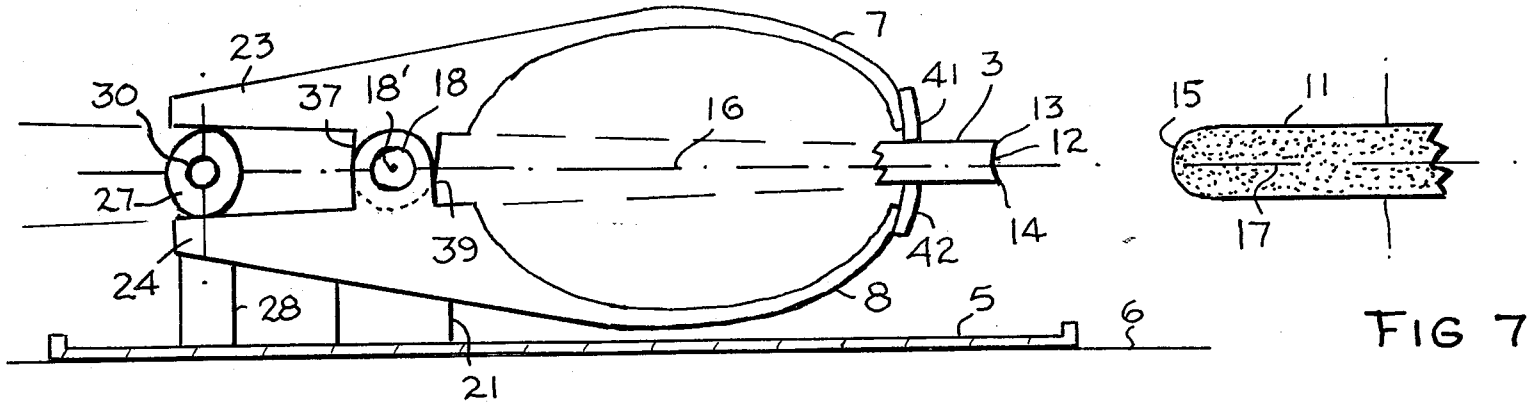

In accordance with the first embodiment of the present invention, illustrated particularly by FIGS. 5 to 7, the jaws are pivotally mounted on a common axle 18 carried eccentrically by discs **19*a* and 19*b* at each end. These discs rotate in yoke 21 that attaches to the base plate and includes two pedestals 21*a* and 21*b* which may be identical to each other and aligned as shown in FIG. 2.** In this embodiment the jaws may also be identical and so the jaws are interchangeable and the pedestals are interchangeable.

Lever arms 23 and 24 from the upper and lower jaws 7 and 8, respectively, extend substantially symmetrically of the plane 16 towards the rear of the clamp assembly. Pads 25 and 26 attached to these arms, respectively, engage a cam 27 (see FIGS. 6 and 7) carried by the cam yoke 28 attached to base plate 5. The cam yoke 28 consists of pedestals **28*a* and 28*b* fixedly attached to the base plate by screws 29. This yoke defines the cam axis 30 which is horizontal to the jaw axle and the cam is rotated on its axis 30 by cam wheel 31.**

The purpose of the cam is to cause the two jaws 7 and 8 to rotate simultaneously together from an open position to a close position gripping the ice skate blade evenly and holding the blade with the central plane 16 of the blade aligned with the central plane 17 of the grinding wheel, as described above. A spring 32 which acts between the two jaws 7 and 8 urges the jaws open so that when the cam is released, the jaws tend to open releasing the ice skate blade.

Figure 3:
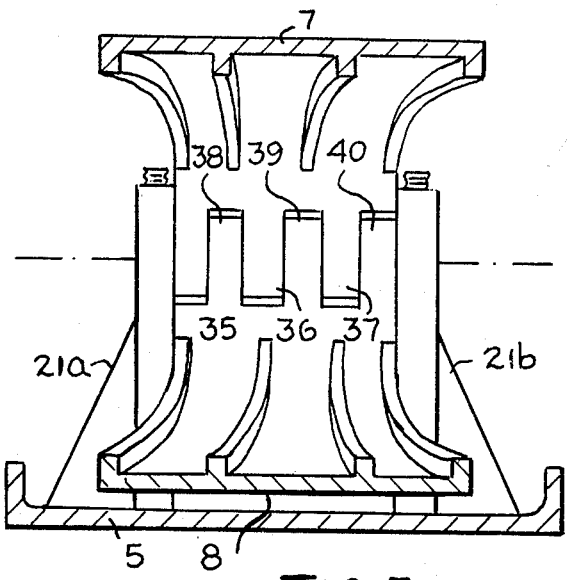
FIG. 3 is a cross section front view of the clamp.

As shown in FIG. 3, the upper and lower jaws 7 and 8 are equipped with interleaved fingers which are bored through laterally and held by the common axle 18. For example, the three fingers 35 to 37 of the upper jaw 7 interleave with the three fingers 38 to 40 of the lower jaw with all bores aligned and the common axle is inserted. The fit between these fingers and the axle is preferably snug, yet allows the jaws to rotate independently of each other on the axle. The fingers inhibit lateral motion of the two jaws with respect to each other and the fit on the axle is sufficiently snug that the pivotal axis 18' of the jaws, defined by the axle, is invariable once the axle discs are locked in position.

Figure 4:
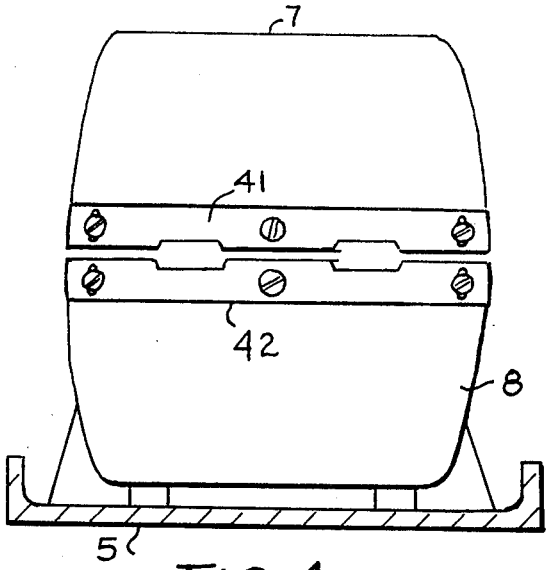
FIG. 4 is a front view of the clamp showing the upper and lower jaw gripping plates.

The front or gripping end of each of the jaws of the clamp, shown in FIG. 4, is equipped with a gripping plate. These are upper jaw gripping plate 41 and lower jaw gripping plate 42. The plates are adjustable so that they can be attached to their respective jaws parallel to each other or at a slight angle to each other. The parallel arrangement is usually preferred. However, to accomodate ice skate blades of tapered thickness from one end to the other, it is sometimes necessary to adjust these gripping plates to insure that they grip the skate blade evenly and firmly.

Operation of the clamp to hold the ice skate for the finishing grind of the blade is illustrated in FIGS. 6 and 7. These figures exaggerate some of te dimensions of parts of the clamp in order to illustrate the operation, however, parts which correspond to the parts described in FIG. 1 to 6 bear the same reference number. The axle 18 can be positioned by loosening the set screws 43 and 44 and rotating the discs 19*a* and 19*b* on their axis 19'. If the axle and discs form a rigid piece, it is clear that the discs are rotated together and locking one, locks both. This rigid structure of axle and discs permits changing the displacement of the axle from the base, but does not permit changing the angle of the axle to the base.

The axle 18 and discs 19*a* and 19*b* need not form a rigid piece and may be so constructed that the axel can pivot where it connects to each disc. For example, the axle could connect to each disc by a ball and socket joint; or, as shown in FIGS. 1 and 5, each end of the axel 18 is recessed to provide studs 45*a* and 45*b* concentric with the axle. These studs fit very loosely in eccentric bores 46*a* and 46*b* in discs 19*a* and 19*b,* respectively, and so there is some pivotal freedom of the axle with respect to each disc. That pivotal freedom allows some independent rotation of the two discs. Thus, from the position shown in FIG. 1, one disc may be rotated clockwise through a slightly greater angle than the other and then both discs are locked by the set screws. This action reduces the separation between axle 18 and base 5 and also tilts the axle so that it is at an acute angle with respect to the base. Indices, such as 47 on the discs and pedestals may be provided to enable the operator to set the angle.

Where the axel 18 is held slightly pivotally at each disc 19*a* and disc 19*b,* to permit tilting the axle, the fit of the interlocked jaws (by interlocking fingers 35 to 40) between the pedestals 21*a* and 21*b* must be loose enough to allow the tilt. This does not mean, however, that the fingers must fit together loosely or that the axle must fit loosely in the accomodating bore through the fingers.

The cam 27 may have any of a variety of shapes. It is generally required that the cam spread the jaw lever arms 23 and 24 together through the same angle so that the gripping plates 41 and 42 close to corresponding equidistant positions on each side of the plane 16, as shown in FIG. 7, to grip the ice skate blade. For example, the cam may be shaped with two planes of symmetry passing through the cam axis 30 and so, the cam may be shaped as an ellipse. When the long axis of this ellipse falls in plane 16, the jaws open as wide as they can as urged by spring 32. Then when the long axis of the ellipse is turned perpendicular to plane 16, the griping plates 41 and 42 close evenly on the ice skate blade 3 gripping and holding it with the central plane 16 of the blade co-planar with the central plane 17 of the grinding wheel 11.

Second Embodiment — Two Axles

In this embodiment, only the jaw axle need be different from the first embodiment. Even the discs by which the axels are mounted to the yoke may be the same as in the first embodiment and the jaws may be identical and interchangeable as well as the pedestals.

Figure 8:
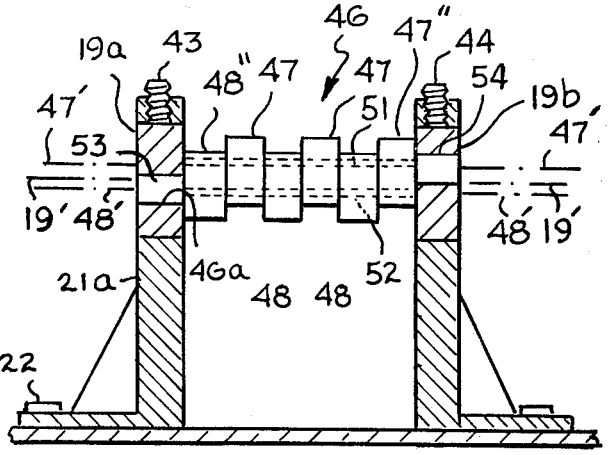
FIG. 8 is a front sectional view showing the two eccentric axels and eccentric mounting discs of the second embodiment.
Figure 11:
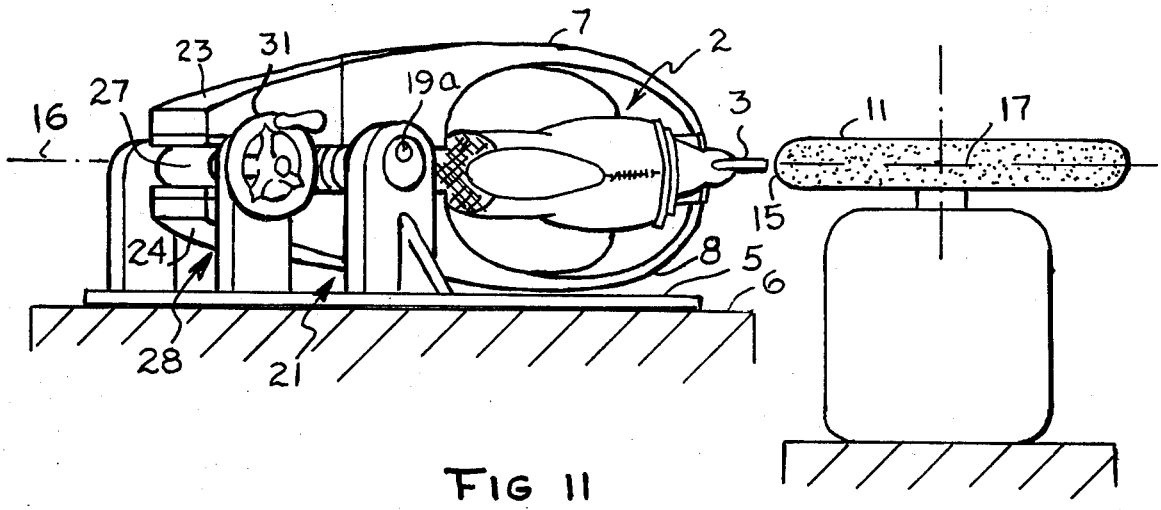
FIG. 11 is a three-quarter view of the clamp holding an ice skate by the blade in position relative to a grinding wheel ready to perform the finishing grind.

The double axel 46, shown in FIG. 8 includes the upper jaw eccentric axel 47 that pivotally supports the upper jaw 7 for rotation on upper jaw axis 47' and the lower jaw eccentric axle 48 that pivotally supports the lower jaw 8 for rotation on the lower jaw axis 48'. Both of these axles 47 and 48, are carried by the discs 19*a* and 19*b* which defines the disc axis 19' and the upper and lower jaw axes 47' and 48' are parallel to and equally spaced from the disc axis 19'. The sections of each axle 47 and 48 are interleaved like the fingers of the jaws so that the upper jaw 7 pivots on axis 47' and the lower jaw 8 pivots on axis 48'.

Where it is intended that the upper and lower jaws be interchangeable and each a single piece, the double axle 46 must be assembled with the jaws. To permit this assembly, the segments of the upper and lower axle come apart and fasten together at the assembly so that the axes 47' and 48' are in fixed relationship to each other. For this purpose, two pins 51 and 52 are inserted through accomodating holes in all the segments of both axle parallel to the axes. These pins hold the axle segments together in fixed eccentric position with respect to each other. At assembly, the segments are inserted in the accomodating bores through the fingers of the jaws, the jaws are then assembled by interleaving the fingers, as shown in FIG. 3, and the two pins 51 and 52 are inserted.

The end segment 48'' of axle 48 has a stud 53 concentric with axis 48' and this stud fits the accomodating bore 46*a* in disc 19*a.* Similarly, the end segment 47'' of axle 47 has a stud 54 concentric with axis 47' that fits the accomodating bore 46*b* in disc 19*b.*

Figure 9:
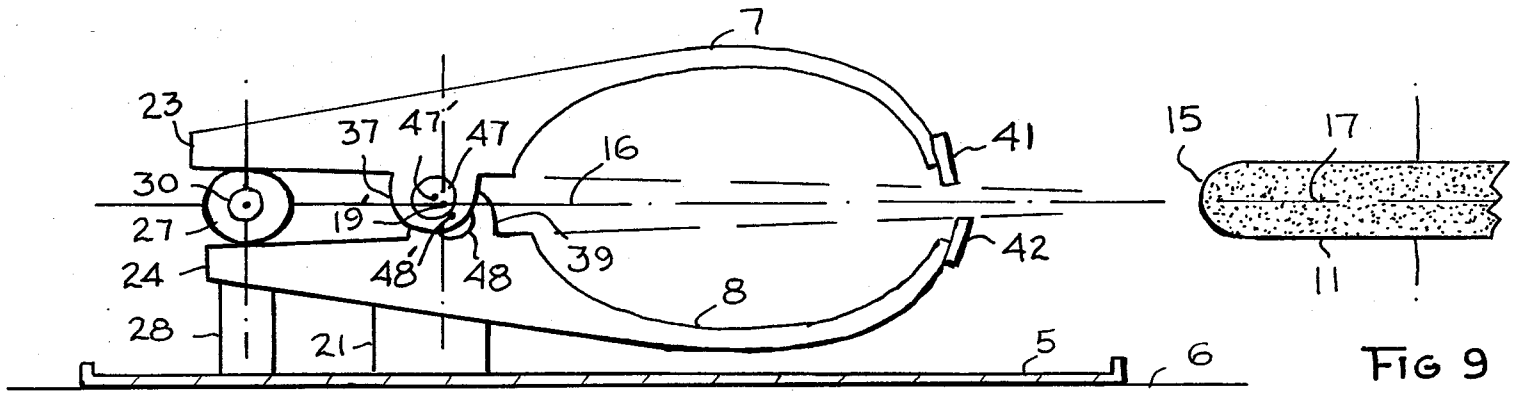
FIGS. 9 and 10 are representative side views showing the second embodiment with jaws opened and closed to hold a relatively thin ice skate blade.
Figure 10:
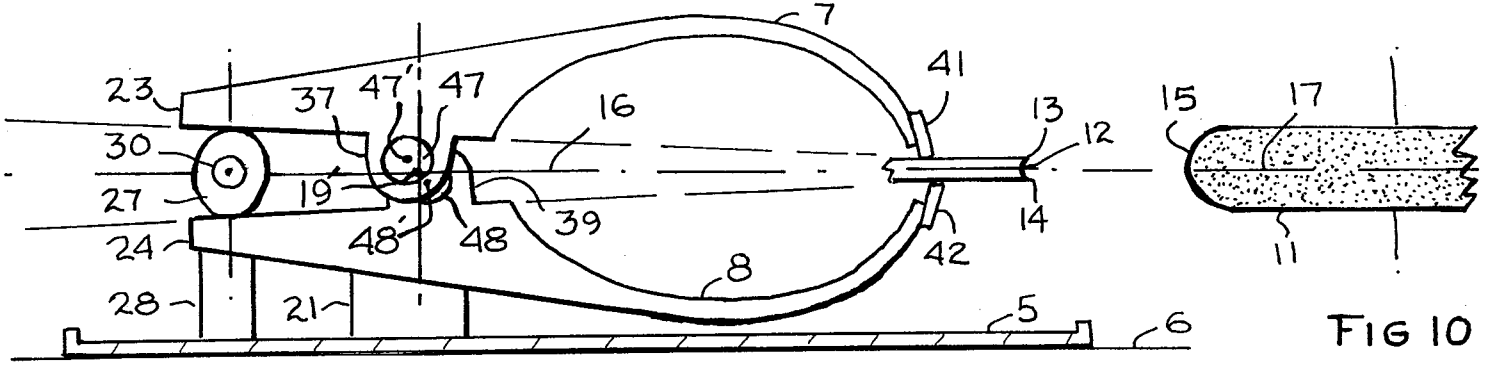

Operation of this embodiment of the clamp is illustrated by FIGS. 9 and 10. These figures exaggerate dimensions to illustrate the function of the double axle. Before the ice skate blade is gripped by the clamp, the discs 19*a* and 19*b* are rotated slightly in yoke 21 to decrease the space between the upper and lower pivot axes 47' and 48' and the central plane 16. For example, when the discs are rotated slightly counterclockwise and then locked by the set screws 43 and 44, the upper and lower axels 47 and 48 are positioned as shown in FIG. 9. At this position, the lower jaw is moved slightly forward and the upper jaw is moved slightly backward, causing a slight misalignment of the two plates 41 and 42. However, those plates are sufficiently thick that they overlap even when this adjustment occurs. Then the relatively thin ice skate blade 3' is gripped and held, as shown in FIG. 10 by rotating the cam 27 so that its major axis is perpendicular to the central plane 16 of the blade.

One function of the double axle is to provide for adjusting the gap between the gripping plates at the end of the jaws to accomodate for gripping thick and thin blades. The double axle shown in FIG. 8 spaces the upper and lower axes 47' and 48' equidistant from the axis 19' of the discs and axis 19' is fixed with reference to the base. Thus, the plane 16 is at a fixed spacing above the base 5 and this spacing cannot be changed. However, where the studs 53 and 54 fit loosely in their accomodating bores 46*a* and 46*b* in discs 19*a* and 19*b,* respectively, one disc may be rotated in its yoke more or less than the other and then when the discs are locked, both axles 47 and 48 will tilt slightly with reference to the base.

As described above with reference to FIG. 8, the double axle may be constructed in segments which are assembled with the fingers of the jaws and then the fingers are interleaved and the pins 51 and 52 are inserted parallel to the axes to lock the axle with respect to each other. In that construction, all the segments of both axels could be identical except the two end segments 47'' and 48'' which carry the studs. That construction of the double axle permits the jaws to be each a single piece and the jaws can be identical.

The two axles 47 and 48 and studs 53 and 54 could be made in a single rigid piece. However, that would require that each jaw be made in at least two pieces. The finger enclosing each segment of an axle would have to be in two parts.

Another alternative is to make the two axles 47 and 48 and discs 19*a* and 19*b* in a single rigid piece. However, that construction would not permit the tilt variation accomplished in the manner described herein.

In all cases, the two axle axes could be unequally spaced from the axis of the discs. Then, a rotation of the discs would raise and lower the gripping plates.

It is sometimes the practice to do a rough grind of the blade to give the blade the desired arc from front to back, against a grinding wheel oriented with the plane of the wheel perpendicular to the plane of the blade. Clearly, the clamp described herein can be used to hold the skate for that purpose also. However, the clamp is particularly useful for accomplishing the finishing or parallel grind that produces the smooth, even edges 13 and 14 and slightly concave surface 12 therebetween.

The embodiments of the present invention described herein, represent the best known use of the invention and incorporate all of the features of the invention. It is to be clearly understood, however, that some of these features can be employed independently of the others to gain at least some of the advantages of the invention. Furthermore, certain minor changes could be made and other combinations of the features could be used without departing from the spirit and scope of the invention set forth in the appended claims.

I claim:

1. A clamp for holding an ice skate by the skate blade while grinding the edge of the blade comrising, a base, first and second jaws, each pivotally attached to the base, means attached to the base for providing a pivot axle for both of said jaws, pivotally connecting the jaws together in spaced relationship to said base, opposed gripping ends of the jaws on one side of said pivot axle for holding the ice skate blade securely therebetween, with the plane of the blade substantially parallel to the base, a yoke attached to the base at each end of the pivot axle, a disc eccentrically connected at each end of the pivot axle, the discs each being rotatably held by one of the yokes, rotatable on a common disc axis parallel to the axis of the axle, means for locking said discs in position in said yokes and means at the other side of said pivot axle for pivoting said jaws in opposite directions with respect to the base, whereby the gripping ends of the jaws close and grip the ice skate blade therebetween in readiness for grinding.

2. A clamp as in claim 1 wherein, at least one of said discs connects loosely with the axle so that the discs can be rotated and locked in the yoke at different rotational positions.

3. A clamp as in claim 2, wherein, the means for pivoting the jaws in opposite directions includes a jaw arm extending from each jaw, a cam between said jaw arms engaging each arm and defining a cam axis of rotation substantially parallel to the disc axis, means attached to the base for holding the cam rotatable on the cam axis and means for rotating the cam.

4. A clamp as in claim 3 wherein, the pivot axis, the disc axis and the cam axis are parallel.

5. A clamp as in claim 4 wherein, the pivot axis and the cam axis both lie substantially in the plane of the ice skate blade.

6. A clamp as in claim 5 wherein, an adjustable plate is provided at the gripping end of each jaw, so attached thereto that the edges of the plates which engage the ice skate blade can be adjusted parallel or non-parallel to each other.

7. A clamp as in claim 1 wherein, first and second pivot axles are provided for the first and second jaws, respectively, said first and second axles are attached together with their respective axes in spaced parallel relationship and the discs are connected eccentrically to both of said axles, whereby rotation of the discs in the yokes on the common disc axis changes the spaced relationship of both of said pivot axles relative to the base.

8. A clamp as in claim 6 wherein, the two pivot axle axes are equally spaced from the common disc axis on diametrically opposed sides thereof.

* * * * *